US007377628B2

(12) United States Patent
Oikawa et al.

(10) Patent No.: US 7,377,628 B2
(45) Date of Patent: May 27, 2008

(54) INK CONTAINER

(75) Inventors: Satoshi Oikawa, Yokohama (JP); Shin Ishimatsu, Fuchu (JP)

(73) Assignee: Canon Kabushiki Kaisha, Tokyo (JP)

( * ) Notice: Subject to any disclaimer, the term of this patent is extended or adjusted under 35 U.S.C. 154(b) by 348 days.

(21) Appl. No.: 11/252,083

(22) Filed: Oct. 17, 2005

(65) Prior Publication Data

US 2006/0082626 A1 Apr. 20, 2006

(30) Foreign Application Priority Data

Oct. 18, 2004 (JP) ..... 2004-303459

(51) Int. Cl.
*B41J 2/175* (2006.01)

(52) U.S. Cl. ..... 347/86

(58) Field of Classification Search ..... 347/85, 347/86, 87

See application file for complete search history.

(56) References Cited

U.S. PATENT DOCUMENTS

| | | | | |
|---|---|---|---|---|
| 5,600,358 | A | 2/1997 | Baldwin et al. | |
| 5,988,803 | A * | 11/1999 | Komplin et al. | 347/86 |
| 6,168,267 | B1 | 1/2001 | Komplin | |
| 6,247,804 | B1 * | 6/2001 | Watanabe | 347/86 |
| 6,394,593 | B1 * | 5/2002 | Komplin et al. | 347/86 |
| 6,755,500 | B2 * | 6/2004 | Hirano et al. | 347/22 |

* cited by examiner

*Primary Examiner*—Anh T. N. Vo
(74) *Attorney, Agent, or Firm*—Canon U.S.A. Inc I.P. Div

(57) ABSTRACT

An ink container includes an ink containing unit having a housing which directly contains ink, an ink guide, a movable member changing the internal volume of the ink containing unit, and a buffer chamber. The buffer chamber allows changing the internal volume of the ink containing unit when the movable member moves, and has an air communicating portion and is defined by a wall structure. A negative pressure controlling mechanism for controlling the negative pressure in the ink containing unit generated when the ink is guided out of the ink containing unit is provided apart from the housing.

7 Claims, 15 Drawing Sheets

INK CONTAINER

BACKGROUND OF THE INVENTION

1. Field of the Invention

The present invention relates to an ink container used in an inkjet recording device.

2. Description of the Related Art

Various methods of supplying ink to a recording head used in an inkjet recording device are known.

In particular, a small recording device, such as that for personal use, often has a structure in which ink is directly supplied to a head from an ink container which is removably mounted to the head.

In such an ink supplying method, a negative pressure controlling mechanism is provided at the ink container which directly supplies ink to the head.

The negative pressure to be controlled is set in equilibrium with the retentivity of a meniscus formed at the ink discharging unit of the head so as to be large enough to prevent ink from leaking from an ink discharging unit of the head, and also within a range which allows the recording head to discharge ink.

Hitherto, many negative pressure controlling mechanisms have generated a suitable negative pressure by the retentivity of ink obtained from an ink absorbent that is accommodated in an ink container. The ink absorbent comprises an aggregate of porous material or fibrous material including and holding the ink.

Recently, in order to achieve high-speed recording, pigment ink is used to increase ink capacity, the efficiency with which ink is contained, and the durability of a recording image.

Accordingly, a structure which directly stores the ink in the container without using an absorbent is becoming frequently used.

As a negative pressure controlling mechanism used in this structure, a movable member is used in a portion of an ink containing space and is biased with, for example, a spring in a direction in which the volume of the ink containing space is increased. In addition, a valve mechanism which opens when the negative pressure (which increases as the amount of ink is reduced in an ink containing unit) reaches a predetermined value is provided.

An example of a valve structure shields the ink containing space from outside air by the retentivity of an ink meniscus produced in a very small gap which is formed in an external wall of the ink container and which connects the ink containing space and the outside air.

In general, a valve structure is used in which outside air is introduced into the ink containing space by breaking the ink meniscus produced in this gap when the negative pressure in the ink containing space becomes equal to or greater than the meniscus retentivity due to the use of ink.

The value of the negative pressure in the ink containing space to which outside air is being introduced at this time can be controlled by the retentivity of the ink meniscus in the gap at the external wall and by the size of the gap.

According to U.S. Pat. No. 5,600,358, which is a first related example, as shown in FIG. 14, an opening connecting the inside of an ink container and the outside and a ball 24 mounted to the opening are provided.

U.S. Pat. No. 5,600,358 discloses a structure in which an orifice 20 for introducing outside air is formed by a gap formed by the ball 24 and the opening.

In U.S. Pat. No. 5,600,358, a narrow labyrinth 30 (air introducing path) connects an opening 18 where the ball is disposed and an opening 44 in contact with the outside air.

The labyrinth 30 prevents ink in the ink container from leaking to the outside when the force of an ink meniscus formed in the orifice is overcome (that is, a liquid seal is broken).

In addition, the labyrinth 30 restricts evaporation of the ink having its meniscus formed in the gap.

U.S. Pat. No. 6,168,267, which is a second related example, discloses, as shown in FIGS. 15 and 16, an ink cartridge comprising an ink containing unit 12, an air chamber 66, a ventilation opening 64 formed between the outside air and the air chamber 66, and a supply port 94 for guiding out the ink in the ink containing unit.

In U.S. Pat. No. 6,168,267, a pressure adjustor 98 and a bubble generator 40 are also provided.

The force of a meniscus in an orifice formed at an aperture 42 of the bubble generator 40 (which is formed at an external wall of the ink cartridge) maintains the outside pressure and the pressure in the ink containing unit at optimum values.

The force of the meniscus formed in the orifice prevents ink from flowing out of the cartridge from the ink containing unit 12 on the one hand, and guides the outside air into the ink containing unit 12 on the other.

The function of the bubble generator 40 in U.S. Pat. No. 6,168,267 corresponds to that of the labyrinth 30 in U.S. Pat. No. 5,600,358.

However, the structures disclosed in U.S. Pat. Nos. 5,600,358 and 6,168,267 have problems due to, for example, the acceleration that is produced when a carriage is subjected to main scanning, falling of the container, application of shock to the container, reduction in viscosity when the temperature of the ink increases, and a difference between the internal and external air pressures of the container.

When a liquid seal provided by the meniscus force is broken, ink cannot be held by a narrow labyrinth (air introducing path) alone, thereby causing the ink to flow out directly to the surrounding environment from the ink containing chamber 12.

In addition, when a channel is formed by hermetically sealing with a cover or a sealant an open side of a groove formed in the external wall of the ink container, the following problem occurs.

When the sealant does not properly seal the open side or when the sealant is damaged by the application of shock thereto, a flow path itself is exposed to the atmosphere, thereby breaking the liquid seal provided by the meniscus force.

As a result, the ink in the ink containing chamber directly leaks to the outside.

SUMMARY OF THE INVENTION

The present invention is directed to an ink container which does not allow liquid to leak to the outside of the ink container from an ink containing chamber in any given situation and which can prevent pollution of the surrounding environment caused by ink.

According to one aspect of the present invention, an ink container includes an ink containing unit including a housing adapted to directly contain ink; an ink guide, disposed at the housing, adapted to guide the ink to the outside of the ink container; a movable member capable of changing the internal volume of the ink containing unit; a buffer chamber allowing changing the internal volume of the ink containing unit responsive to the movable member moving, the chamber having an air communicating portion and defined by a wall structure. In the ink container, a negative pressure controlling mechanism controls the negative pressure in the ink containing unit generated when the ink is guided out of the ink containing unit and is provided apart from the housing.

In one embodiment, the buffer chamber includes the wall structure, a surface of the housing, and a flexible sheet member having a side facing the surface, having its periphery in close contact with the wall structure, and being included in the movable member.

The negative pressure controlling mechanism may be provided at the wall structure defining the periphery of the buffer chamber.

The negative pressure controlling mechanism may have a tubular structure having a first connector at one end thereof and a second connector at the other end thereof, with the first connector being connected to the buffer chamber and the second connector being connected to the ink containing unit of the ink container. The second connector may have a valve structure including a hole and a stopper, an edge of the hole and the stopper defining a gap facilitating forming an ink meniscus.

The tubular structure may have a meandering form or the form of a labyrinth.

The air communicating portion of the buffer chamber may be disposed apart from a location situated at a surface which becomes a bottom surface of the ink container when the ink is guided out of the ink container.

A member which passes a gas but does not pass a liquid may be provided in the buffer chamber near the air communicating portion.

A porous member may be provided in the buffer chamber near the air communicating portion.

As described above, according to the present invention, it is possible to, by disposing the negative pressure controlling mechanism in the container instead of at the external wall of the container, prevent damage to the negative pressure controlling mechanism even if an unexpected shock is applied to the ink container when, for example, the ink container is dropped.

In addition, since the negative pressure controlling mechanism opens into the buffer chamber in the ink container and does not directly communicate to the external wall of the ink container, ink in the ink containing unit is stored in the buffer chamber even after a shock is applied to the container, so that the possibility of the ink leaking to the outside of the ink container is reduced.

Since air outside the ink container is introduced into the ink containing unit through the negative pressure controlling mechanism instead of being directly introduced into the ink containing unit, a large variation in the pressure in the ink containing unit is restricted.

Further features of the present invention will become apparent from the following description of exemplary embodiments with reference to the attached drawings.

DESCRIPTION OF THE EMBODIMENTS

Embodiments of the present invention will hereunder be described with reference to the drawings.

First Embodiment

Figure 1:
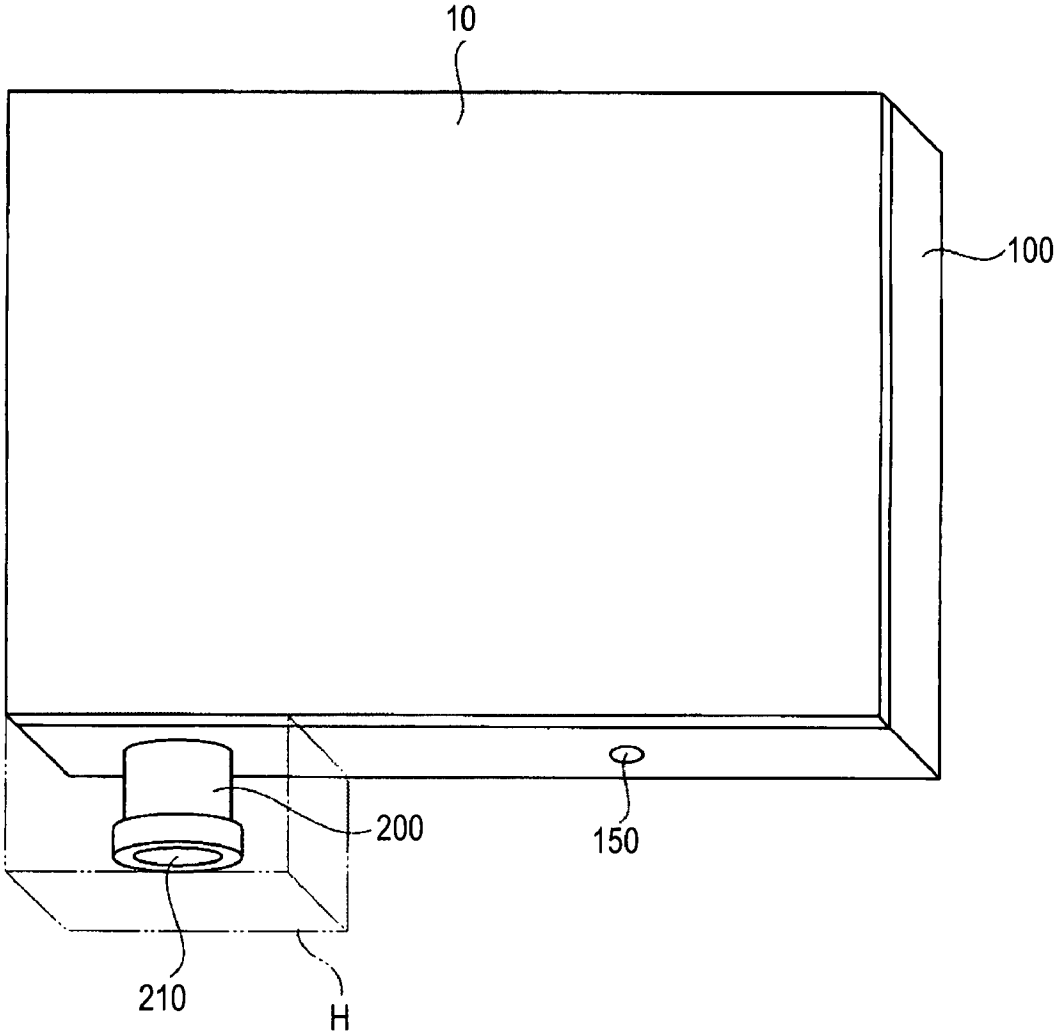
FIG. 1 is an external perspective view of an ink container according to a first embodiment of the present invention.
Figure 2:
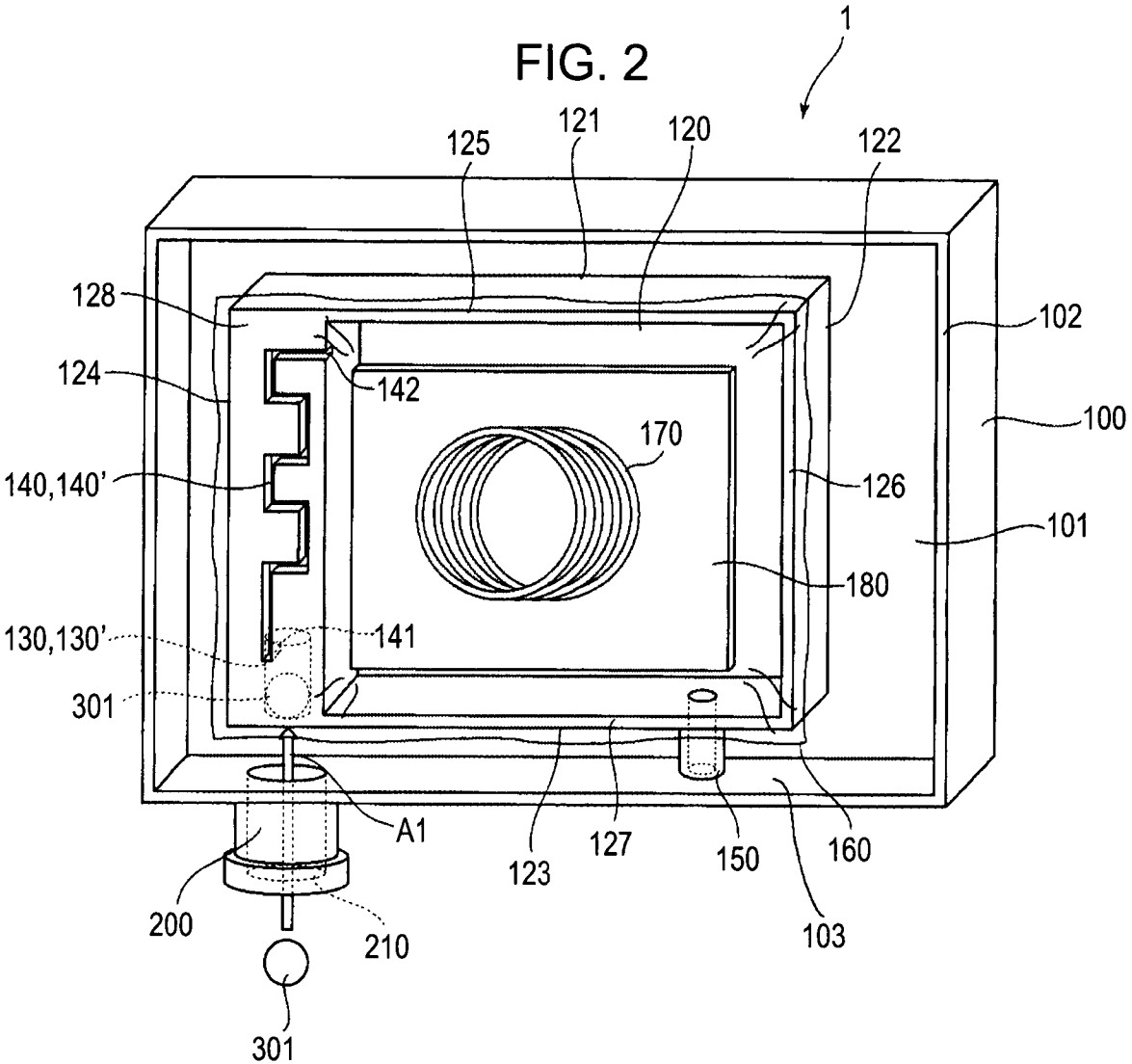
FIG. 2 is an internal schematic view of the ink container according to the first embodiment of the present invention without a cover.
Figure 3:
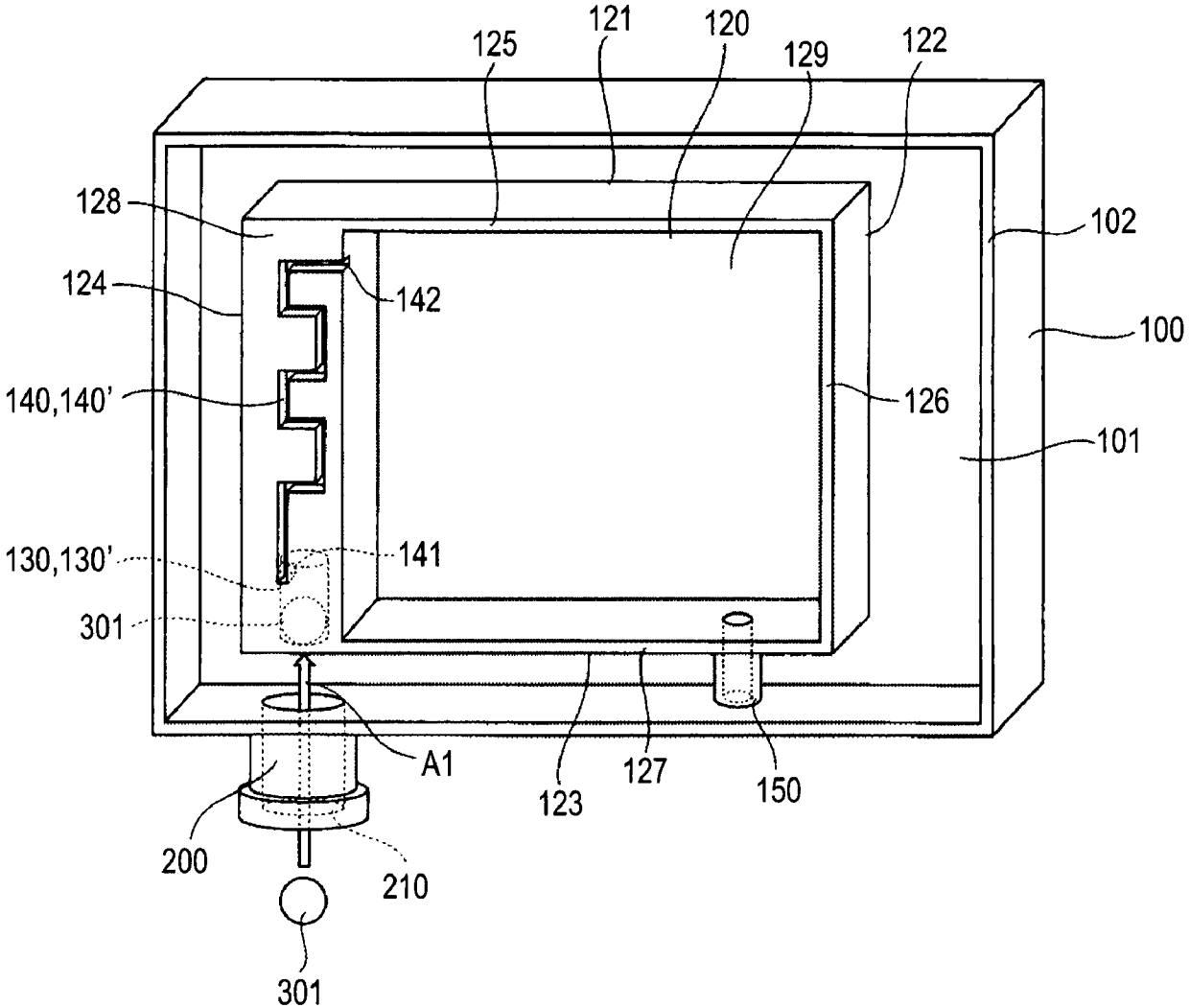
FIG. 3 is a schematic perspective view of the main portion of the ink container according to the first embodiment of the present invention.

FIG. 1 is an external perspective view of an ink container according to a first embodiment of the present invention. FIG. 2 is a schematic perspective view of the ink container without its cover so as to have its internal portion exposed. FIG. 3 is a schematic perspective view of a state in which the main portion of the ink container according to the first embodiment is exposed without the cover and several other members.

An ink container 1 has a relatively flat and substantially parallelepiped shape, and has a structure in which a cover 10 is in close contact with the entire ink container cover seal surfaces 102 corresponding to top edges of external walls 100 of the ink container 1.

An ink guide 200 is provided so as to protrude from a portion of the external wall 100, such as a wall which becomes the bottom wall in a perpendicular direction when the ink container 1 is used (that is, when it is set in a posture that it assumes when it is mounted to an inkjet recording device). The ink guide 200 can be connected to an inkjet recording head H.

The ink guide 200 has a hollow cylindrical form. A guide path 210 extends parallel to the side wall 100 of the ink container 1. One end of the guide path 210 is connected to an ink inlet, and the other end thereof faces and opens into an ink containing unit 101 disposed in the ink container 1.

The ink container 1 may be integrated to the inkjet recording head H so as to be inseparable therefrom, or may be connectable through the inkjet recording head H (or a suitable flow path member).

Here, considering that the ink container 1 is handled as a single unit, a mechanism for closing the ink guide path 210 may be provided in the ink container 1. For example, a valve for opening and closing an ink connection path by an ink introducing unit of the inkjet recording head when the ink container is mounted to or removed from the inkjet recording head may be used.

The simplest closing structure is one in which a resilient member, such as a rubber member, having a slit for receiving a tubular member defining the ink inlet of the recording head is disposed at one end of the ink guide path 210.

By closing the slit when the tubular member is not inserted, it is possible to prevent the leakage of ink.

An air chamber 120 (buffer chamber) surrounded by first to fourth air chamber walls 121 to 124 is formed in the ink containing unit 101.

A surface which is a portion of a housing of the ink container 1 itself is used as a surface 129 defining the air chamber 120.

A sheet member 160 formed of a flexible material is disposed at a side facing the surface 129 defining the air chamber 120.

The sheet member 160 is mounted to the entire first to fourth sheet member sealing surfaces 125 to 128 (corresponding to the edges of the air chamber walls 121 to 124) by being brought into close contact with the entire sealing surfaces 125 to 128 by, for example, hot welding while the sheet member 160 is flexed to a certain extent.

A pressure plate 180 which is slightly smaller than an opening defined by the edges of the air chamber walls 121 to 124 is placed on the sheet member 160.

A biasing member 170, such as a spring, disposed between the pressure plate 180 and the cover 10 biases the pressure plate 180 and the sheet member 160 towards the bottom surface 129 of the air chamber 120.

The internal space of the air chamber 120 is directly connected to the outside air through an air communicating portion 150 extending from the wall 123 to a wall 103 of the ink container 1. (In the illustrated example, the wall which becomes the bottom wall in a vertical direction when the ink container 1 is set in a posture that it assumes when the ink container 1 is used is the wall 103.)

In other words, the ink container 1 has a hermetically sealed structure excluding the two portions of the ink container 1 where the air communicating portion 150 connecting the air chamber 120 to the outside air and the ink guide path 210 connecting the ink containing unit 101 to the inkjet recording head are formed.

These are the features of the external structure of the embodiment.

In other words, the related examples, such as that disclosed in U.S. Pat. No. 6,168,267, feature, in addition to the structure of the aforementioned exemplary embodiment, a valve structure disposed at a portion of an external wall of the ink container to control the negative pressure and related flow paths, so that the ink containing unit can be directly connected to the air.

Next, the structure of a negative pressure controlling mechanism regarding a main portion in the embodiment will be described. FIG. 3 shows the ink container 1 without the sheet member 160 functioning as a buffer of the volume of the ink containing unit 101, the pressure plate biasing member 170, and the pressure plate 180.

Of the first to fourth air chamber walls 121 to 124 of the air chamber 120, the fourth air chamber wall 124 is thick, and faces the ink guide 200 and an end of the opening of the ink guide path 210 in the ink container 1 are formed.

A cul-de-sac hole 130 having a diameter that is smaller than the diameter of the opening of the ink guide path 210, having an internal diameter that gradually decreases towards the inner side, and having a substantially circular shape in cross section is formed in the air chamber wall 124 so as to be coaxial with the opening of the ink guide path 210.

A spherical stopper 301 is press-fitted to the hole 130 in the direction of an illustrated arrow Al from the opening of the ink guide path 210.

The stopper 301 has a size that allows the entire stopper 301 to be substantially accommodated in the hole 130 as indicated by broken lines.

Figure 4:
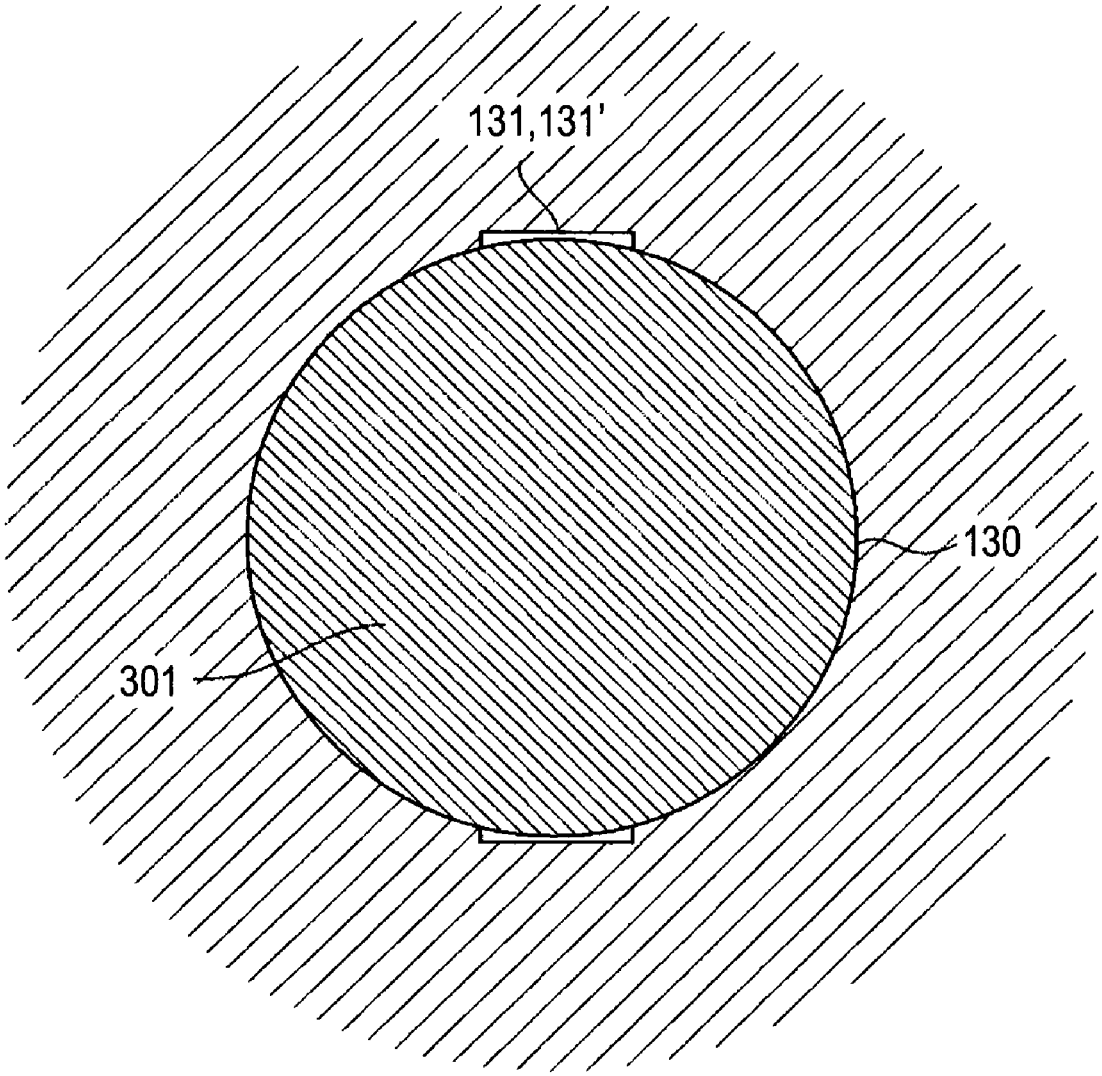
FIG. 4 is an enlarged view of a meniscus holder at a stopper in the first embodiment of the present invention as seen in the direction of arrow Al in FIG. 3.

A groove 131 which forms a predetermined gap when the stopper 301 is press-fitted to the hole 130 is formed at the hole 130 as shown in FIG. 4 which is a transverse sectional view of the portion where the stopper 301 is press-fitted to the hole 130.

A groove 140 extending in a relatively complicated path (meandering path in FIG. 3) to a location near the air chamber 120 from a location near the backmost portion of the hole 130 is formed in the sealing surface 128 at the edge of the fourth air chamber wall 124.

Ends of the groove 140 are connected, respectively, to a space at the back side of the hole 130 where the stopper 301 is positioned through a connector 141 and to the air chamber 120 through a connector 142.

When the sheet member 160 is in close contact with the entire first to fourth sealing surfaces 125 to 128, the open side of the groove 140 is covered with the sheet member 160.

This causes an air introducing path 140' extending from the air chamber 120 to the space at the back side of the hole 130 where the stopper 301 is positioned to be formed.

The space at the back side of the hole 130 forms an air introducing chamber 130' for introducing air to the ink containing unit 101. The gap formed between the stopper 301 and the groove 131 formed at the hole 130 forms a meniscus holder 131'.

The size of the meniscus holder 131' is determined in accordance with the retentivity of a meniscus formed in an ink discharge opening of the inkjet recording head.

The meniscus holder 131' has a size which does not prevent an ink discharge operation of the head and ink re-fill to the ink discharge opening (or a liquid path connecting to the ink discharge opening) and which allows the negative pressure in the ink containing unit 101 to be maintained so as not to allow ink to leak from the discharge opening when the ink is not being discharged.

As mentioned above, the internal portion of the air chamber 120 is connected to the outside air through the air communicating portion 150.

In contrast, the ink containing chamber 101 is not connected to the outside air because, ordinarily, an ink meniscus is formed in the meniscus holder 131' when the ink is contained in the ink containing chamber 101.

Next, the operation of the ink container according to the embodiment will be described.

Figure 5:
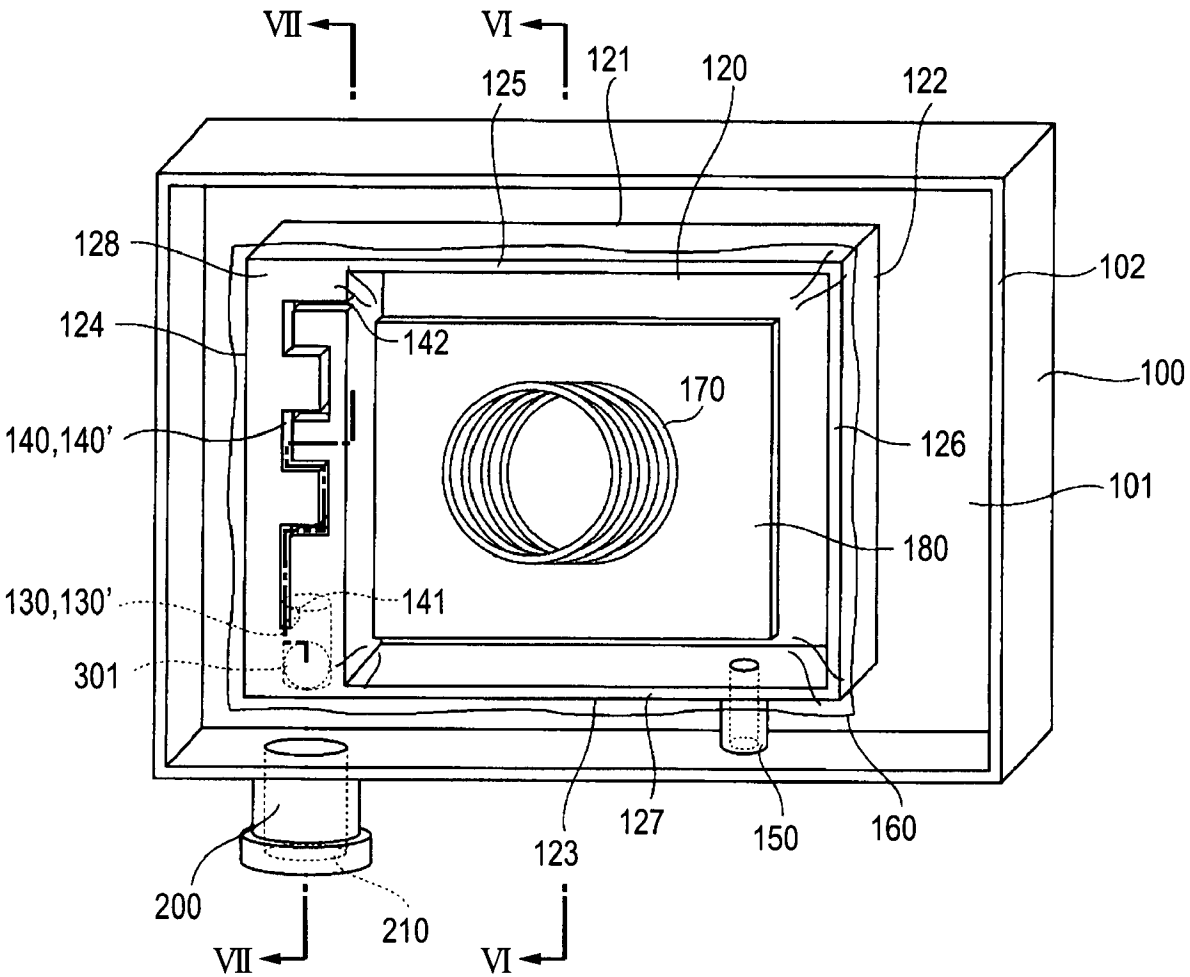
FIG. 5 shows the ink container without the cover and is used to illustrate the cross-sectional locations in FIGS. 6 and 7.
Figure 6:
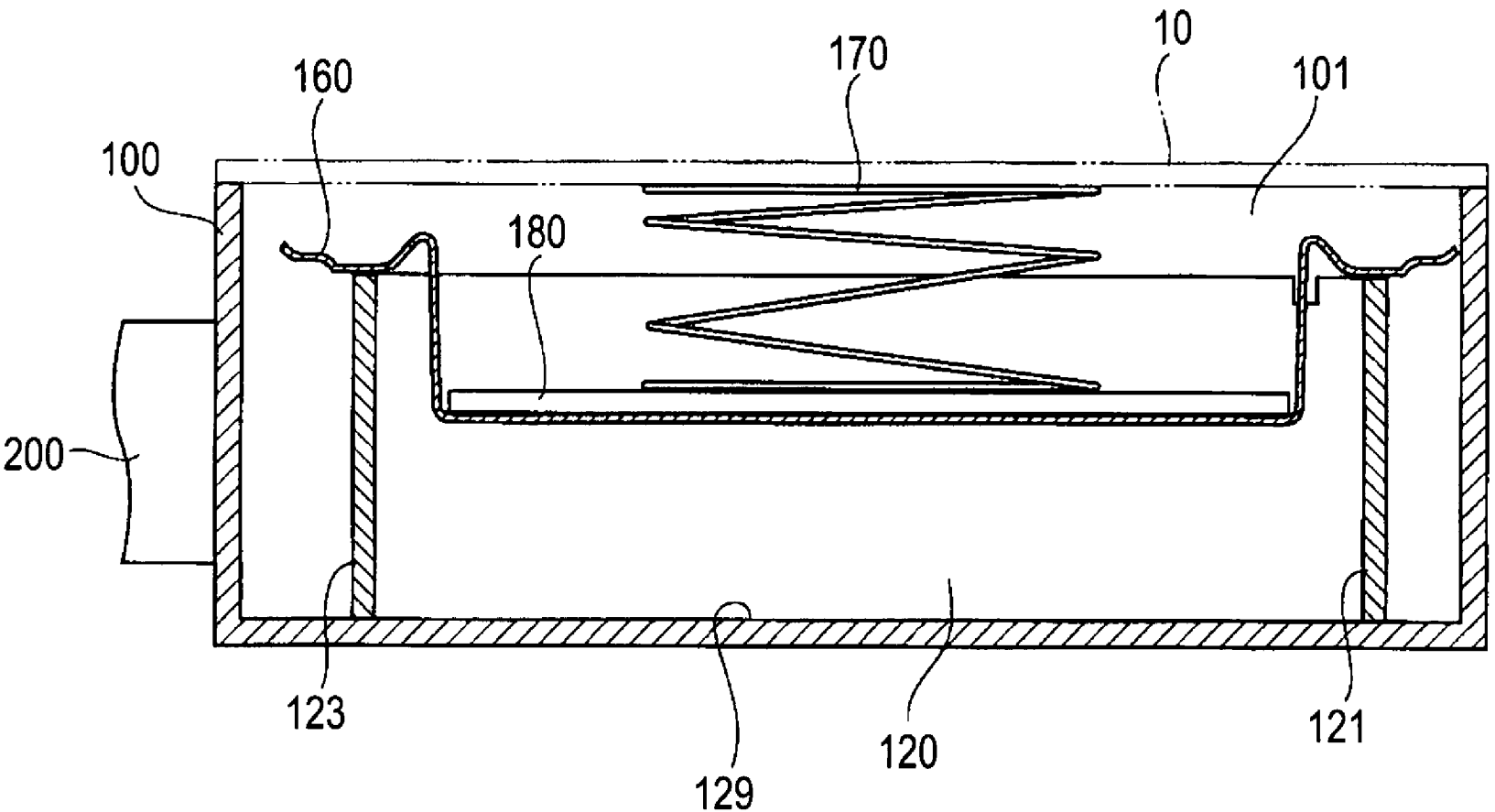
FIG. 6 is a sectional view of the ink container according to the first embodiment of the present invention taken along line VI-VI shown in FIG. 5.

FIG. 5 is, like FIG. 2, a schematic perspective view of the ink container 1 without the cover 10, and FIG. 6 is a sectional view taken along line VI-VI shown in FIG. 6.

The amount of ink in the ink containing unit 101 is reduced by an ink discharging operation of the inkjet recording head H (see FIG. 1) connected to the ink guide 200.

This operation causes flexed portions of the pressure plate 180 and the sheet member 160 to go against the biasing force of the pressure plate biasing member 170, and to move away from the bottom surface of the air chamber 120 (that is, in a direction in which the volume in the air chamber 120 is increased).

The movement of the pressure plate 180 causes the volume in the ink containing unit 101 to be adjusted (that is, reduces the volume of the internal portion of the ink containing unit 101).

Here, the air chamber 120 takes in air from the opening of the air communicating portion 150 so as to maintain atmospheric pressure therein.

A phenomenon may occur in which air bubbles existing with the ink and air dissolved in the ink in the ink containing unit 101 expand due to an increase in the internal pressure of the ink containing unit 101 relative to the pressure of the surrounding environment which has been reduced.

When such a phenomenon occurs, the flexed portions of the pressure plate 180 and the sheet member 160 move in the biasing direction of the pressure plate biasing member 170 (that is, in the direction in which the volume in the air chamber 120 is reduced), thereby reducing the internal pressure (negative pressure) of the ink containing unit 101.

Here, the air chamber 120 releases air to the outside from the opening of the air communicating portion 150, thereby maintaining atmospheric pressure.

As described above, the air chamber 120 functions as a buffer of the volume of the ink containing unit 101.

Figure 7:
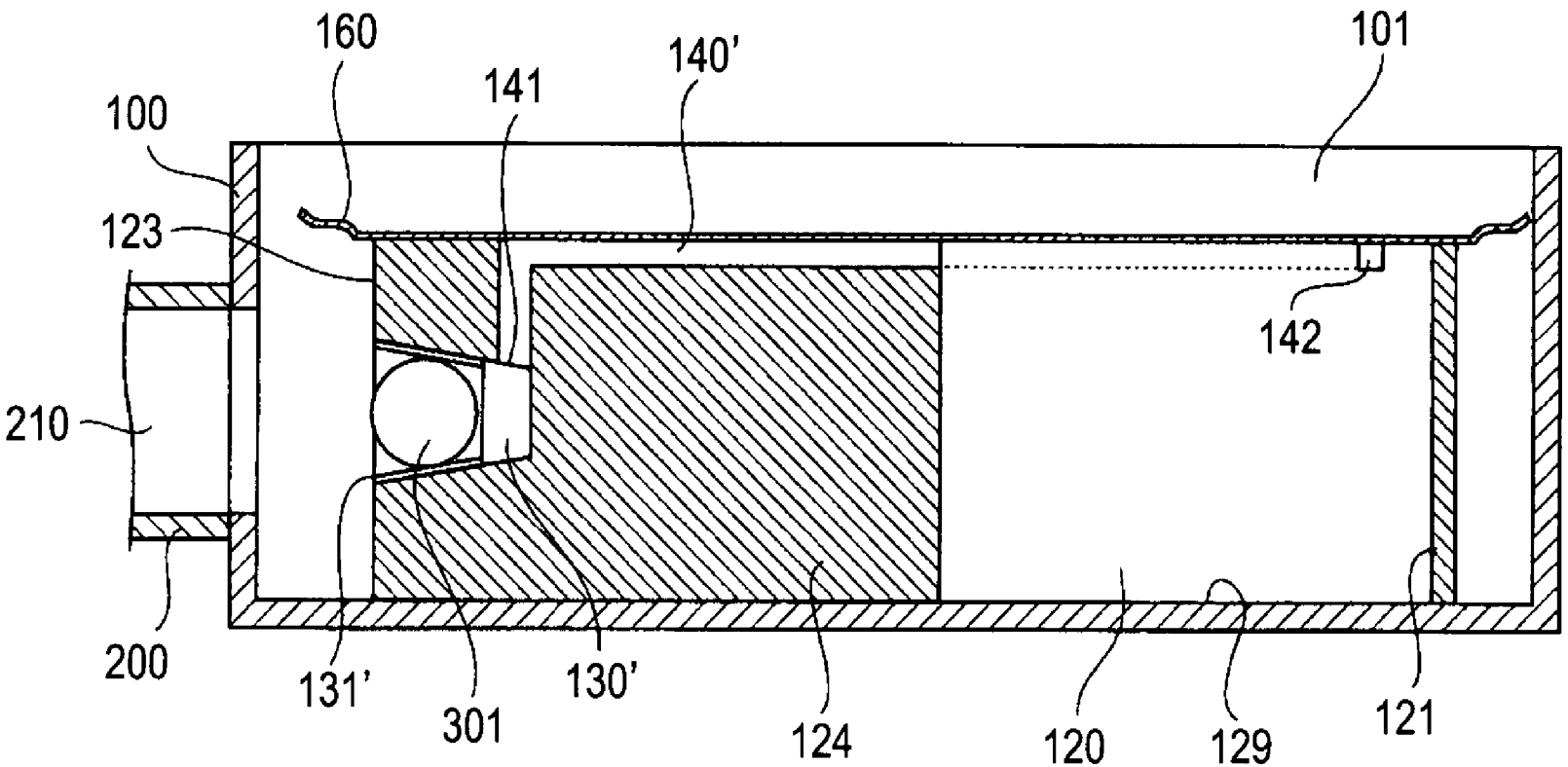
FIG. 7 is a sectional view of the ink container according to the first embodiment of the present invention taken along line VII-VII shown in FIG. 5.

The operation of the negative pressure controlling mechanism regarding a main portion in the embodiment will be described with reference to FIG. 7. FIG. 7 is sectional view taken along line VII-VII shown in FIG. 5.

When ink is contained in the ink containing unit 101, a meniscus of the ink is formed in the meniscus holder 131'.

Therefore, when the ink container 1 is a single unit, that is, when it is not connected to the inkjet recording head, the opening of the ink guide 210 is hermetically sealed by a means which is not shown as mentioned above. Therefore, the ink container 1 is also hermetically sealed.

When the ink container 1 is mounted to the recording head, the amount of ink in the ink containing unit 101 is reduced by an ink discharging operation by the recording head.

This causes the negative pressure in the hermetically sealed ink containing unit 101 to increase.

At first, as the amount of ink in the ink containing unit 101 is reduced, the flexed portions of the pressure plate 180 and the sheet member 160 go against the biasing force of the pressure plate biasing member 170 and move away from the bottom surface of the air chamber 120.

Since the volume of the ink containing unit 101 is adjusted, the negative pressure in the ink containing unit 101 is constant.

However, as the ink is further consumed, the amount of compression of the pressure plate biasing member 170 is increased. When this amount of compression reaches a predetermined amount, the pressure plate biasing member 170 substantially cannot be compressed, as a result of which the volume of the ink containing unit 101 can no longer be adjusted.

Thereafter, as the ink is consumed, the negative pressure in the ink containing unit 101 is increased.

When the negative pressure reaches a predetermined value, the meniscus of the ink formed in the meniscus holder 131' is broken.

Outside air is introduced into the ink containing unit 101 through the opening of the air communicating portion 150, the air chamber 121, the air introducing path 140', and the air introducing chamber 130'.

The introduction of the outside air causes the negative pressure in the ink containing unit 101 to be reduced.

When the negative pressure in the meniscus holder 131' reaches a predetermined value, a meniscus is formed again in the meniscus holder 31', causing the ink containing unit 101 to be hermetically sealed.

The increase in the negative pressure caused by the consumption of the ink and hermetical re-sealing of the ink containing unit resulting from the introduction of outside air and the reduction of the negative pressure are repeated until the ink container 1 runs out of ink.

In the ink container according to the embodiment, the negative pressure controlling mechanism including a valve structure and an air introducing path is disposed in the ink container instead of at an external wall of the ink container as in the related examples.

The valve structure including the hole 130, the groove 131 and the stopper 301, and the air introducing path 140' are formed at the air chamber wall 124 of the internal structure of the ink container 1.

Therefore, even if an unexpected shock produced by, for example, dropping the ink container 1 is applied to the ink container, the possibility of damaging the valve structure and the flow path is very low.

The valve structure including the hole 130 and the stopper 131 is connected to the air chamber 120, formed in the ink container 1, through the air introducing path 140'.

The ink containing unit 101 is formed so that, as the negative pressure increases, it takes in outside air not directly but through the air chamber 120.

Even if a phenomenon in which ink in the ink containing unit flows out through the air introducing path 140' after entering from the valve structure when the ink meniscus in the valve structure is broken by the application of an unexpected shock or an excessive environmental change (such as a reduction in pressure) occurs, the ink that has flowed out flows into the air chamber 120, so that it is very unlikely for the ink to leak out of the ink container.

In other words, the air chamber 120 functions, not only as a buffer of the volume of the ink containing unit 101 when the ink is being consumed, but also as a buffer chamber for preventing ink from leaking to the outside, that is, to the surrounding environment.

Figure 8:
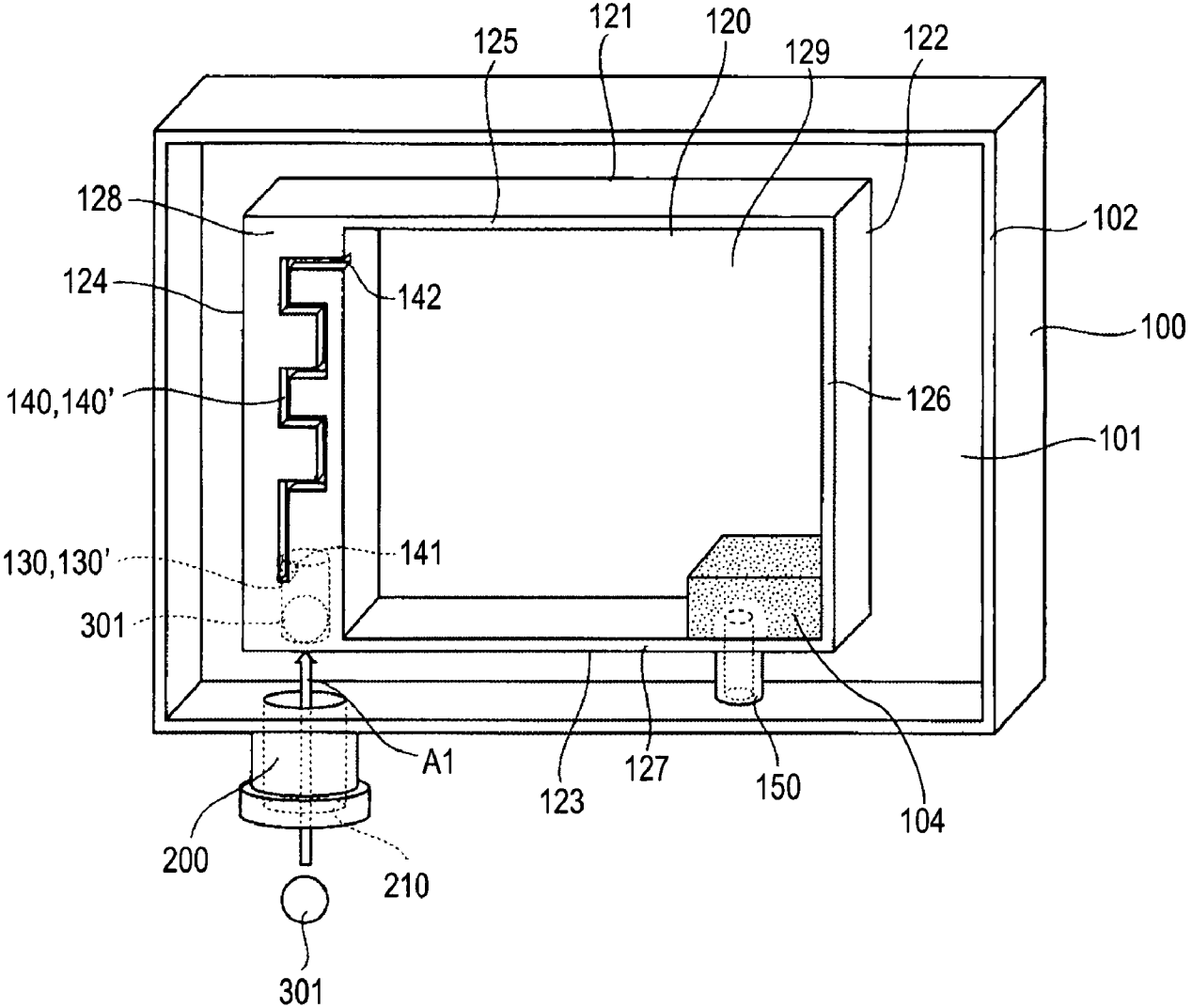
FIG. 8 shows a member which passes air but does not pass a liquid into an air chamber or a porous member in the first embodiment of the present invention.

Here, as shown in FIG. 8, a member 104 may be provided which passes air but does not pass a liquid into the air chamber 120 so that the ink which has flowed into the air chamber 120 does not leak to the outside of the ink container 1 through the air communicating portion 150.

Similarly, a structure including a porous member having a certain thickness may be provided in a portion in the air chamber 120 near the air communicating portion 150.

Second Embodiment

The structure according to the present invention is not a structure which allows the internal portion of the ink containing unit to be directly connected to the outside air, but a structure which allows the internal portion of the ink containing unit to be connected to the outside through the paths in the ink container and the buffer chamber.

The present invention aims at overcoming the problem of ink leaking to the outside due to the application of an unexpected shock or an environmental change, so that suitable structures and arrangements of the component parts can be used.

For example, it is obvious that the air communicating portion 150 which is formed at the surface of the ink container 1 corresponding to the bottom surface when the ink container 1 is set in a posture that it assumes when the ink container 1 is used (that is, when the ink container is mounted to the inkjet recording head) may be disposed at other portions of the ink container 1.

Figure 9:
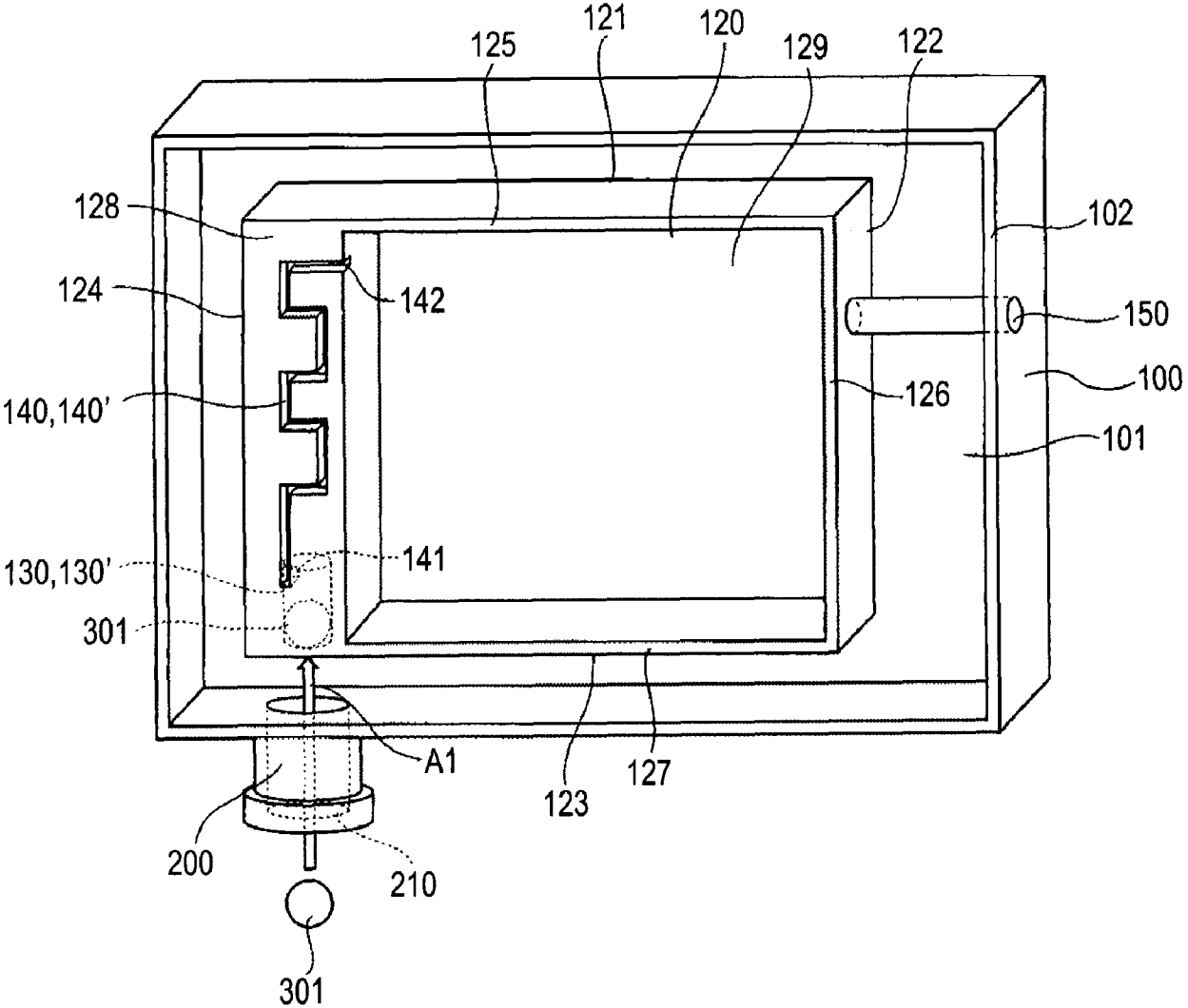
FIG. 9 is a sectional view in which an air communicating portion is formed in a surface other than the surface which becomes the bottom surface of the ink container when the ink container is set in a posture that it assumes when ink is used in a second embodiment of the present invention.

For example, if the air communicating portion is a tubular member extending inwardly towards the air chamber as shown in FIG. 9, it is possible to effectively prevent ink which has flown into and has been stored in the air chamber from leaking to the outside.

As mentioned above, the size of the meniscus holder 131' is determined in accordance with a desirable retentivity of a meniscus formed in an ink discharge opening of the inkjet recording head.

Therefore, if this condition is satisfied, the shape of the meniscus holder 131' is not limited to that shown in FIG. 4, so that it may have, for example, the following shapes.

Third Embodiment

Figure 10:
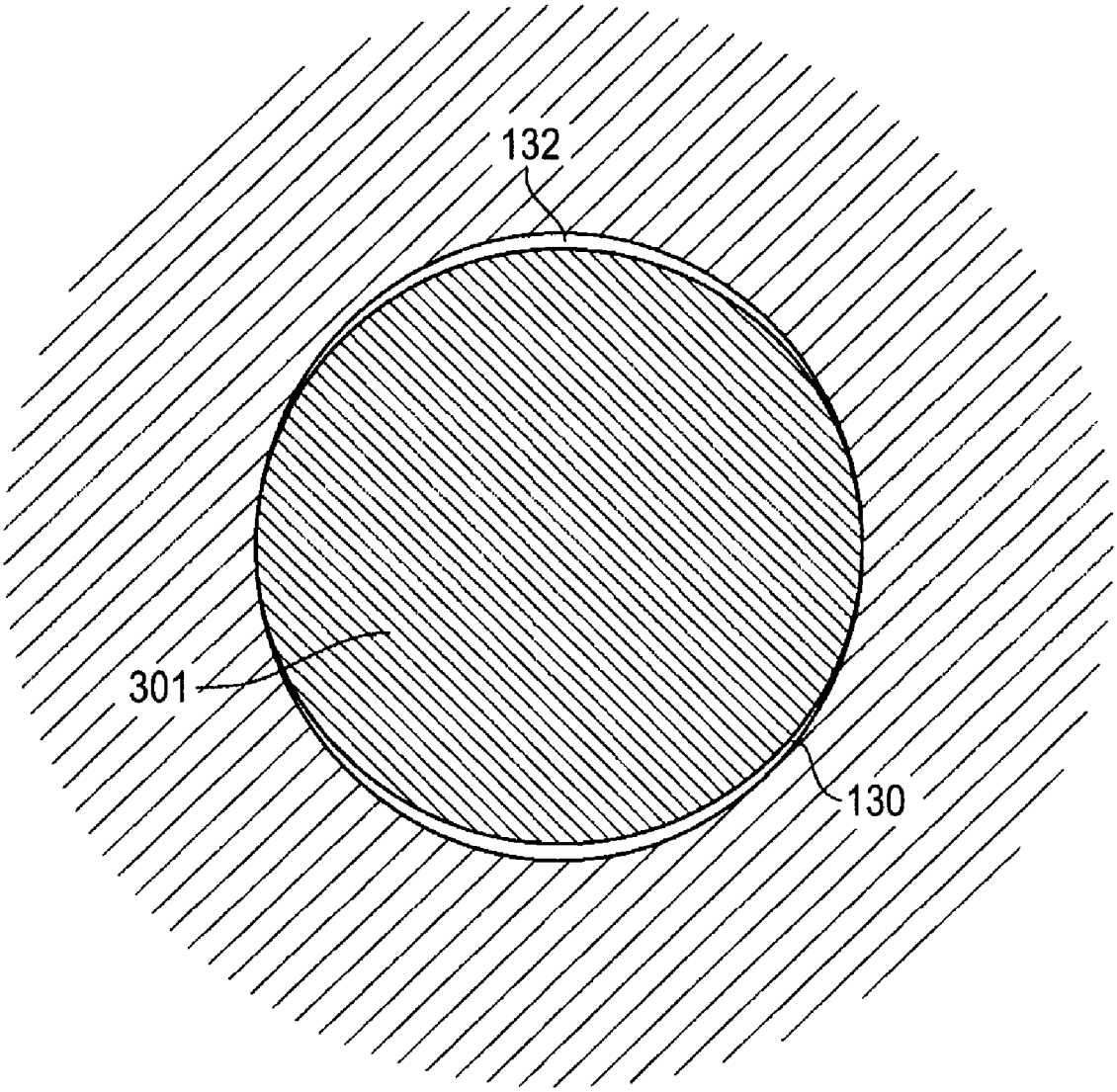
FIG. 10 is a sectional view in which a hole at a meniscus holding stopper is elliptical in a third embodiment of the present invention.

FIG. 10 is a transverse sectional view of a portion where a stopper is press-fitted at a portion of a meniscus holder in another embodiment of the present invention.

A hole 130 having an elliptical shape in cross section is used instead of the hole having a substantially circular shape in cross section and having the groove 131 formed thereat. When a spherical stopper 301 is press-fitted to the elliptical hole 130, a very small gap 132 is formed for holding a meniscus.

Fourth Embodiment

Figure 11:
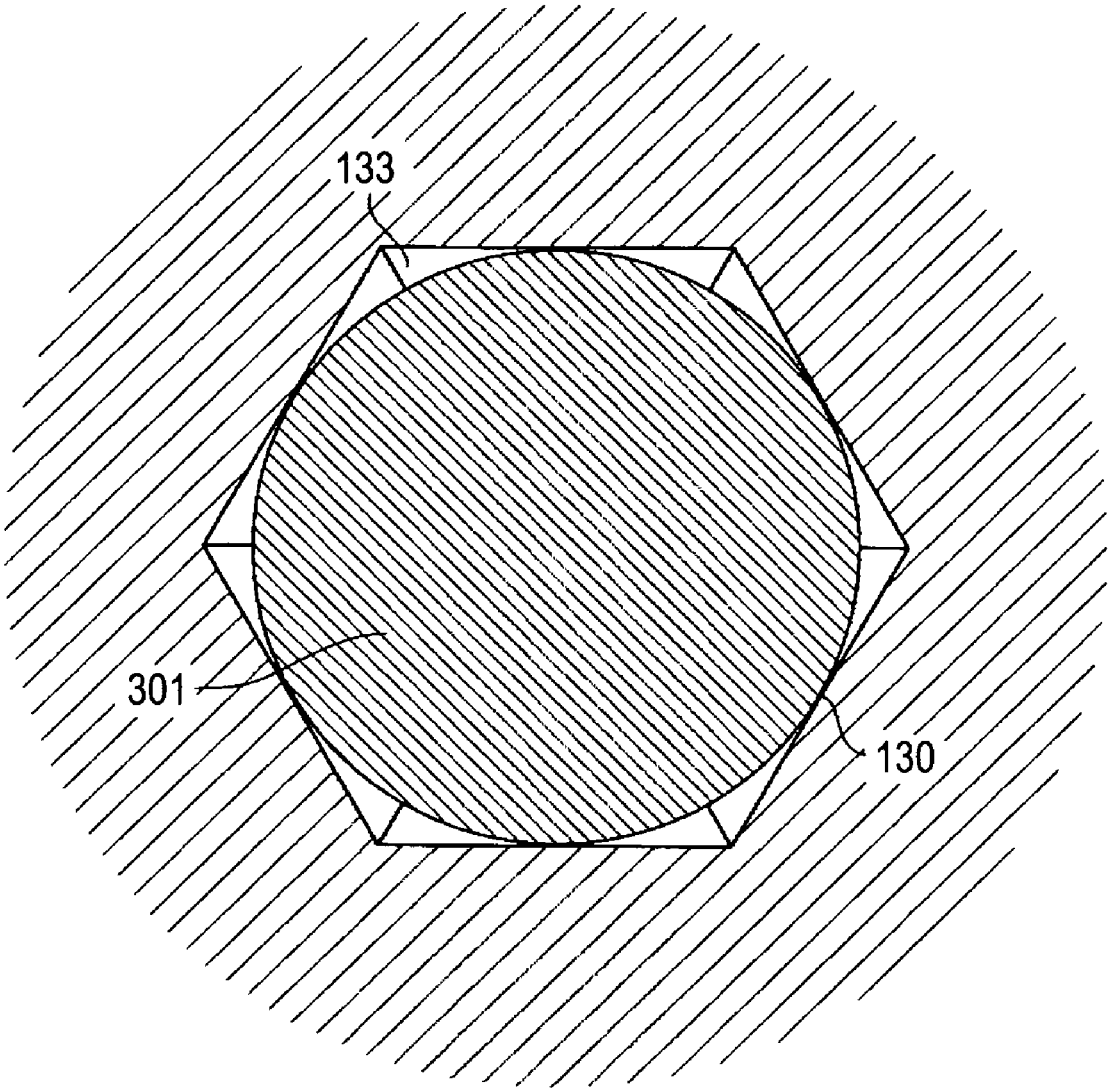
FIG. 11 is a sectional view in which a hole at a meniscus holding stopper is polygonal in a fourth embodiment of the present invention.

FIG. 11 is a transverse sectional view of a portion where a stopper is press-fitted at a portion of a meniscus holder in still another embodiment of the present invention.

In this embodiment, a hole 130 has a hexagonal shape in cross section. When a spherical stopper 301 is press-fitted to the hexagonal hole 130, very small gaps 133 are formed in the respective corners of the hole 130 for holding a meniscus.

In a modification of this embodiment, the hole 130 may have a different polygonal shape in cross section.

Fifth Embodiment

Figure 12:
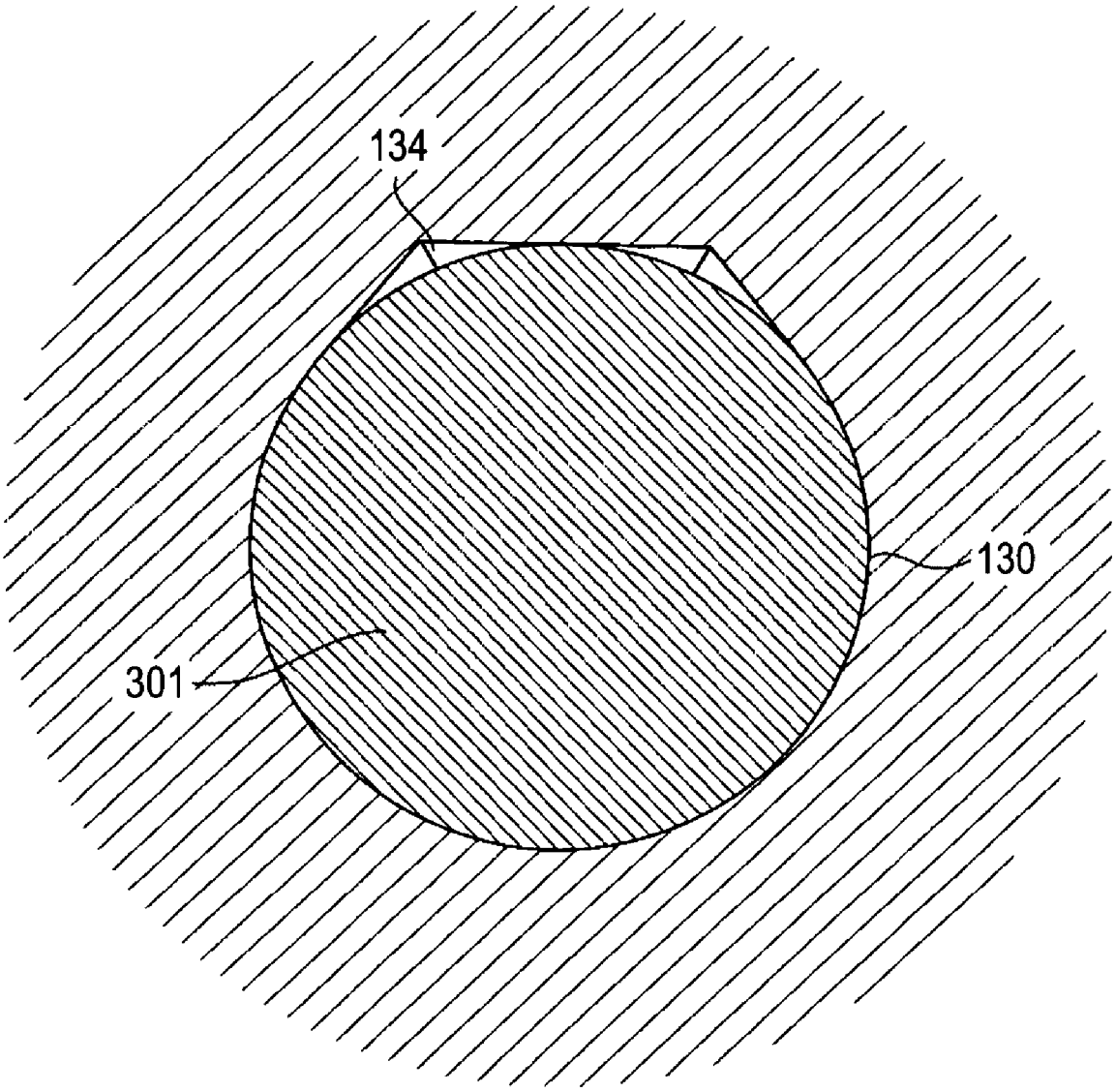
FIG. 12 a sectional view in which a hole at a meniscus holding stopper has a curved portion and a linear portion in a fifth embodiment of the present invention.

FIG. 12 is a transverse sectional view of a portion where a stopper is press-fitted at a portion of a meniscus holder in still another embodiment of the present invention.

The cross-sectional shape of a hole 130 has an arcuate curved portion and a linear portion. When a spherical stopper 301 is press-fitted to this hole 130, a very small gap 134 is formed in a portion where the linear portion and the curved portion contact each other for holding a meniscus.

In a modification of this embodiment, a plurality of linear portions are provided at different locations in the cross-sectional shape of the hole 130.

Instead of forming a gap by suitably setting the shape of the hole 130, the gap may be formed by, for example, forming the hole 130 with a circular shape on the one hand, and forming the stopper 301 with an aspherical shape on the other.

In the first embodiment, the hole 130 of the valve structure of the negative controlling mechanism is formed in the air chamber side wall 124 including an end surface facing the ink guide 200 so as to be coaxial with the opening of the ink guide 201.

When forming the valve structure, the stopper 301 can be press-fitted from the outside of the ink container 1. Therefore, this structure is advantageous from the viewpoint of the manufacturing process.

However, if the valve structure is disposed in the ink container 1, it may be disposed in another location, such as at any one of the air chamber walls 121 to 123.

This also similarly applies to the air introducing path 140' connecting the valve structure and the air chamber 120.

In the embodiments, the air introducing path 140' is formed by a groove formed in one surface of the air chamber side wall 124 and the sheet member 160 covering this surface.

This structure is advantageous because the manufacturing process is simplified and the number of parts is reduced and because a desirable shape of the air introducing path 140' can be selected from a larger number of choices.

The air introducing path 140' may be a hole passing through the side wall or a separate tubular member.

It is important for the air introducing path 140' to be formed with a shape which effectively restricts leakage of ink from the gap for controlling negative pressure and evaporation of the ink whose meniscus is formed in the gap.

The shape of the air introducing path is not limited to a meandering shape as in the embodiments. Therefore, it is obvious that it may have a linear shape, a bent shape, or a curved shape.

Although the valve mechanism controls the negative pressure by a force of an ink meniscus formed in the gap defined by the stopper and the edge of the hole, that is, by liquid sealing, it may also be a mechanical unidirectional valve having a valve member which can be displaced in accordance with a pressure difference.

Example of Application to Inkjet Recording Device

Figure 13:
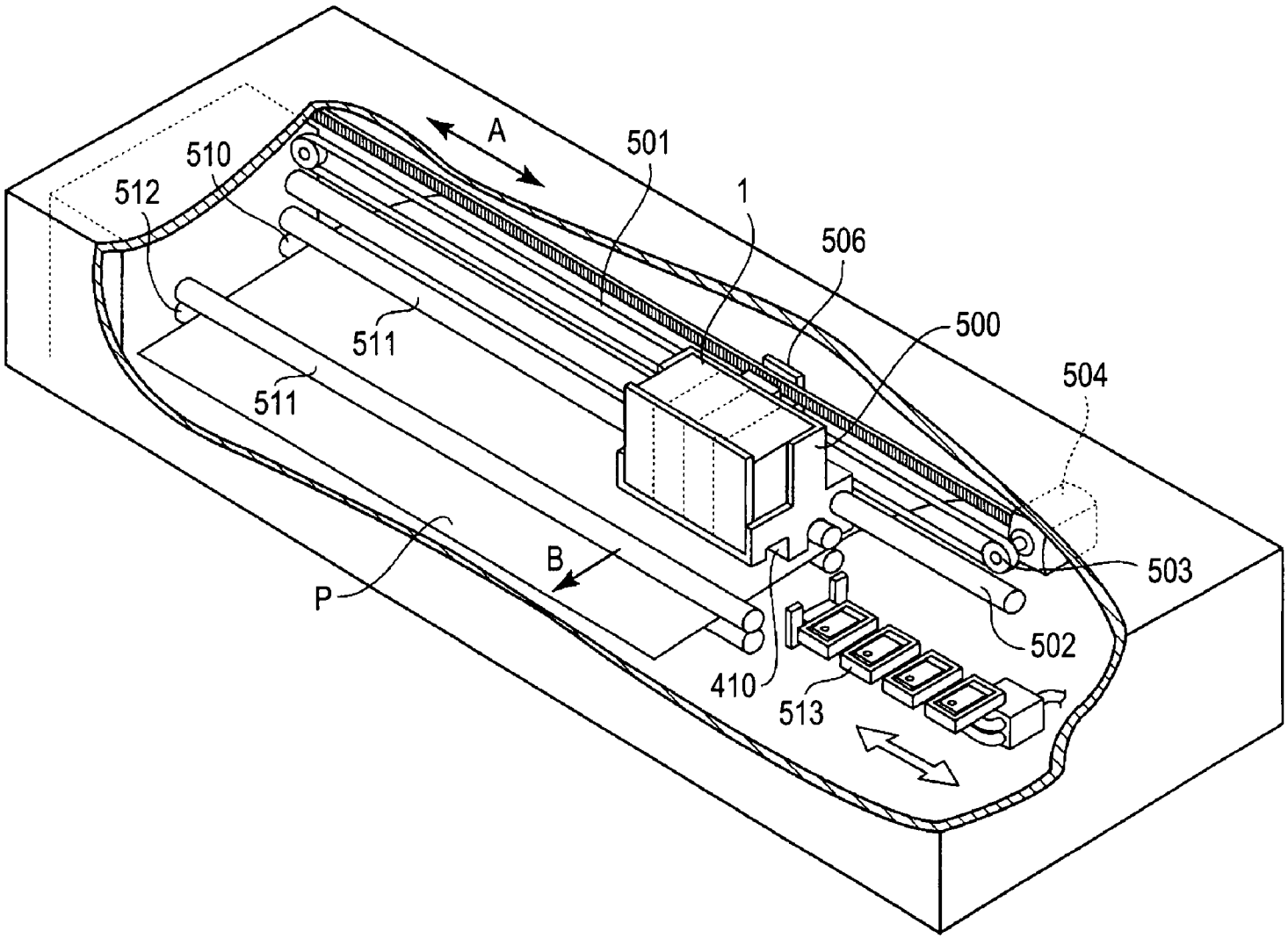
FIG. 13 is a schematic view of an example of a structure of an inkjet recording device to which any one of the aforementioned ink containers can be removably mounted.
Figure 14:
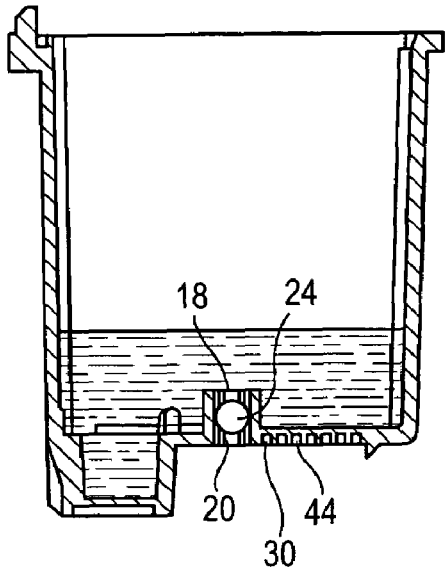
FIG. 14 PRIOR ART
FIG. 14 is a sectional view of an ink container which is a first related example with regard to the invention.
Figure 15:
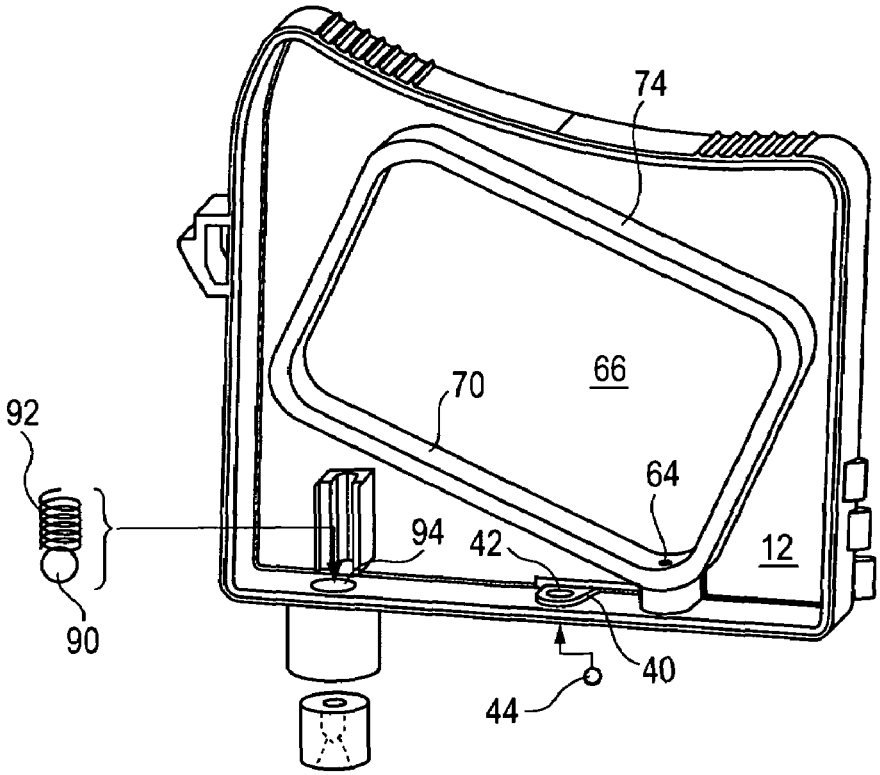
FIG. 15 PRIOR ART
FIG. 15 is a sectional view of an ink cartridge which is a second related example with regard to the invention.
Figure 16:
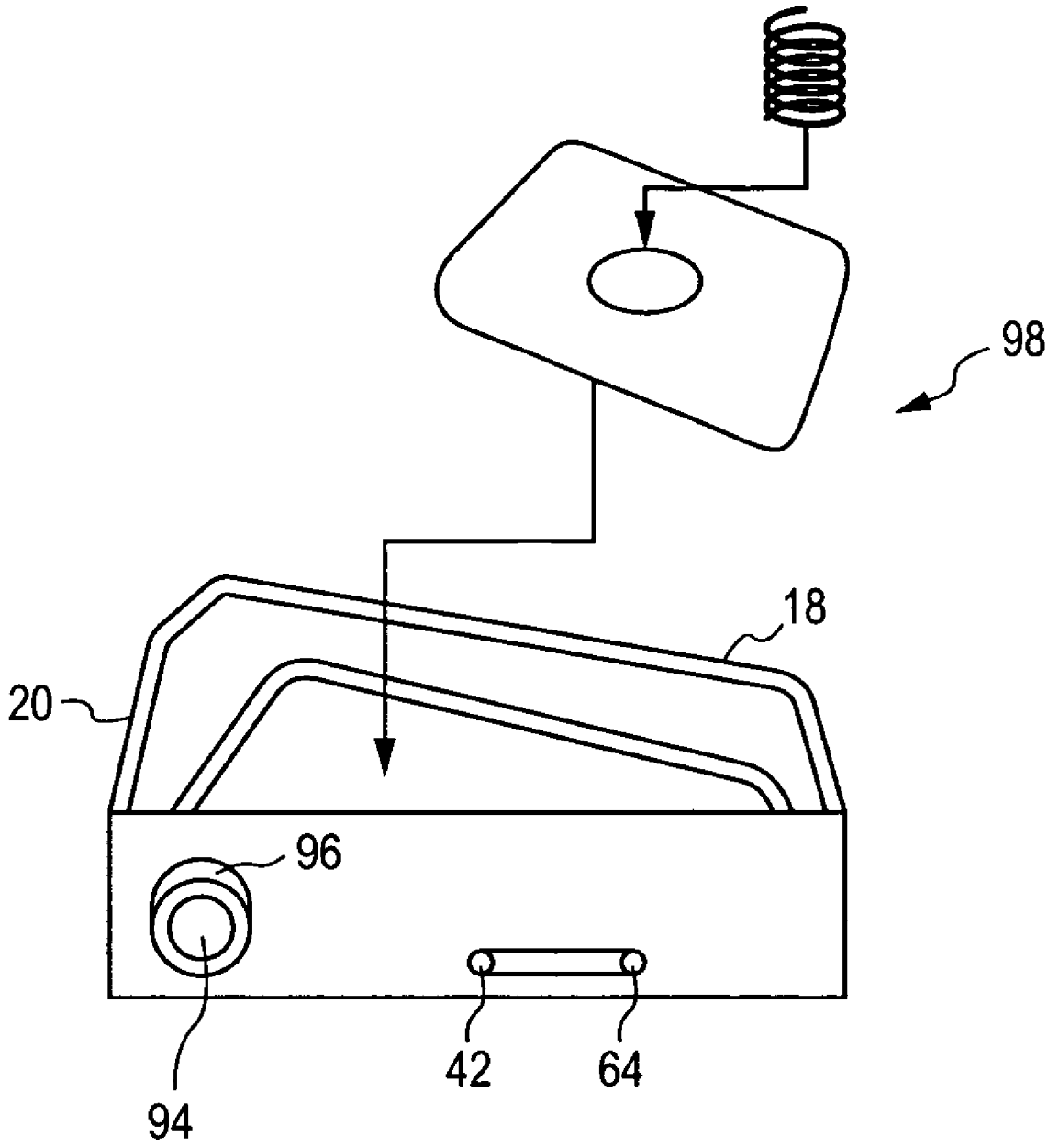
FIG. 16 PRIOR ART
FIG. 16 shows the ink cartridge which is the second related example.

FIG. 13 is a schematic view of an example of the structure of an inkjet recording device to which any one of the above-described ink containers can be removably mounted.

In the illustrated inkjet recording device, a carriage 500 is secured to an endless belt 501 and is movable along a guide shaft 502. The belt 501 is wound upon pulleys 503. A drive shaft of a carriage drive motor 504 is connected to the pulley 503.

The carriage 500 is subjected to main scanning along the guide shaft 502 in a reciprocation dimension (directions of a double-headed arrow A) as a result of the rotational driving of the motor 504.

An inkjet head unit is installed on the carriage 500 so that a row of discharge openings face a sheet P and so that the direction of arrangement is the same as a direction differing from a main scanning direction (for example, a sub-scanning direction which is the direction of transportation of the sheet P).

The number of sets of an ink discharge opening row and the ink container 1 may be in accordance with the ink colors used. In the illustrated example, four sets are used in accordance with four colors (such as black, yellow, magenta, and cyan).

A linear encoder 506 is provided in the illustrated recording device for the purpose of, for example, detecting the position of movement of the carriage 500 in the main scanning directions.

The recording sheet P, which is a print medium, is intermittently transported in the direction of arrow B which is perpendicular to the scanning directions of the carriage 500.

The recording sheet P is supported by a pair of roller units 509 and 510, disposed upstream in the transportation direction, and by a pair of roller units 511 and 512, disposed downstream in the transportation direction. A certain tension is applied to the recording sheet P to transport the recording sheet P in a flat state with respect to the ink discharge openings.

By virtue of the above-described structure, the entire sheet P is printed while alternately printing and transporting the sheet P. In the printing operation, a width of the sheet P corresponding to a width of arrangement of the discharge openings of an inkjet head 410 is printed by the movement of the carriage 500.

The carriage 500 stops at the home position at the start of the printing operation or during the printing operation when necessary.

Caps 513 for capping the surface of the inkjet head 410 where the discharge openings are formed are provided at this home position.

A suction recovery unit (not shown) for preventing, for example, clogging of the discharge openings by forcefully sucking ink out of the discharge openings is connected to the caps 513.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-303459 filed Oct. 18, 2004, which is hereby incorporated by reference herein in its entirety.

What is claimed is:

1. An ink container comprising:

an ink containing unit including a housing adapted to directly contain ink;

an ink guide, disposed at the housing, adapted to guide the ink to the outside of the ink container;

a movable member capable of changing the internal volume of the ink containing unit;

a buffer chamber allowing changing the internal volume of the ink containing unit responsive to the movable member moving, the buffer chamber having an air communicating portion and defined by a wall structure; and a negative pressure controlling mechanism controlling the negative pressure in the ink containing unit generated responsive to the ink being guided out of the ink containing unit, the negative pressure controlling mechanism being provided apart from the housing and at the wall structure defining the periphery of the buffer chamber.

2. The ink container according to claim 1, wherein the buffer chamber includes:

the wall structure;

a surface of the housing; and a flexible sheet member having a side facing the surface, having its periphery in close contact with the wall structure, and being included in the movable member.

3. The ink container according to claim 1, wherein the negative pressure controlling mechanism has a tubular structure having a first connector at one end thereof and a second connector at the other end thereof, the first connector being connected to the buffer chamber, the second connector being connected to the ink containing unit, and wherein the second connector has a valve structure including a hole and a stopper, an edge of the hole and the stopper defining a gap facilitating forming an ink meniscus.

4. The ink container according to claim 3, wherein the tubular structure has one of a meandering form and the form of a labyrinth.

5. The ink container according to claim 1, wherein the air communicating portion is disposed apart from a location situated at a surface which becomes a bottom surface of the ink container when the ink is guided out of the ink container.

6. The ink container according to claim 1, wherein a member which passes a gas but does not pass a liquid is provided in the buffer chamber near the air communicating portion.

7. The ink container according to claim 1, wherein a porous member is provided in the buffer chamber near the air communicating portion.

* * * * *